US010698338B2

(12) United States Patent
Kojima

(10) Patent No.: US 10,698,338 B2
(45) Date of Patent: Jun. 30, 2020

(54) IMAGE FORMING APPARATUS

(71) Applicant: CANON KABUSHIKI KAISHA, Tokyo (JP)

(72) Inventor: Takehiro Kojima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/424,767

(22) Filed: May 29, 2019

(65) Prior Publication Data

US 2019/0294075 A1 Sep. 26, 2019

Related U.S. Application Data

(63) Continuation of application No. PCT/JP2017/043892, filed on Nov. 30, 2017.

(30) Foreign Application Priority Data

Dec. 1, 2016 (JP) ..... 2016-234194

(51) Int. Cl.
*G03G 15/06* (2006.01)
*G03G 15/10* (2006.01)

(52) U.S. Cl.
CPC ..... *G03G 15/065* (2013.01); *G03G 15/10* (2013.01); *G03G 15/105* (2013.01)

(58) Field of Classification Search
CPC ..... G03G 15/065; G03G 15/10–11
See application file for complete search history.

(56) References Cited

U.S. PATENT DOCUMENTS 8,792,796 B2 7/2014 Kella et al.
2003/0185595 A1* 10/2003 Kellie ..... G03G 15/101 399/237

(Continued)

FOREIGN PATENT DOCUMENTS

JP H07-160062 A 6/1995
JP H10-268645 A 10/1998

(Continued)

OTHER PUBLICATIONS

PCT International Search Report and Written Opinion dated Feb. 20, 2018, in PCT/JP2017/043892.

(Continued)

*Primary Examiner* — Carla J Therrien
(74) *Attorney, Agent, or Firm* — Venable LLP

(57) ABSTRACT

An image forming apparatus executes a first obtain mode to obtain a resistance value of a developing roller when a potential difference between the developing roller and an electroconductive roller is generated by a second voltage generator when the developing roller carries a reference liquid developer having a known toner concentration. A second obtain mode is executed to obtain a toner concentration of the liquid developer on a surface of the developing roller based on the obtained resistance value and a detection result when a potential difference between the developing roller and the electroconductive roller is generated by the second voltage generator when the liquid developer is applied to the developing roller. During image formation, the controller controls a first voltage generator based on the obtained toner concentration so the toner concentration of the liquid developer on the surface of the developing roller is a target value.

4 Claims, 9 Drawing Sheets

(56) References Cited

U.S. PATENT DOCUMENTS

| | | | | |
|---|---|---|---|---|
| 2003/0185596 | A1* | 10/2003 | Kellie | G03G 15/065 399/240 |
| 2005/0169671 | A1* | 8/2005 | Kellie | G03G 15/101 399/237 |
| 2008/0317489 | A1* | 12/2008 | Kamoda | G03G 15/105 399/57 |
| 2010/0296825 | A1* | 11/2010 | Kella | G03G 15/105 399/31 |
| 2011/0020023 | A1* | 1/2011 | Hirai | G03G 15/105 399/57 |
| 2015/0055984 | A1* | 2/2015 | Lior | G03G 9/132 399/237 |
| 2015/0071665 | A1* | 3/2015 | Lam | G03G 15/0851 399/60 |
| 2016/0342108 | A1* | 11/2016 | Montag | G03G 15/065 |

FOREIGN PATENT DOCUMENTS

| | | | |
|---|---|---|---|
| JP | H11-65297 | A | 3/1999 |
| JP | 2001-056611 | A | 2/2001 |
| JP | 2006-243047 | A | 9/2006 |
| JP | 2008-083341 | A | 4/2008 |
| JP | 2010-526338 | A | 7/2010 |

OTHER PUBLICATIONS

Takehiro Kojima, U.S. Appl. No. 16/424,781.
Takehiro Kojima, U.S. Appl. No. 16/424,795.

* cited by examiner

IMAGE FORMING APPARATUS

This application is a continuation of PCT Application No. PCT/JP2017/043892, filed on Nov. 30, 2017.

TECHNICAL FIELD

The present invention relates to an image forming apparatus in which image formation is carried out by utilizing a developing device for developing an electrostatic latent image, carried on a latent image bearing member, through a wet developing type by using a liquid developer in which toner is dispersed in a medium liquid.

BACKGROUND ART

Electrophotography in which the electrostatic latent image formed on the latent image bearing member such as a photosensitive member is developed with charged toner and an image is formed has become widespread. As the electrophotography of this kind, for example, a dry developing method directly using powdery toner and a wet developing method (liquid developing system) using the liquid developer in which the toner is dispersed in a liquid exist. Of these, in the liquid developing system, the toner is dispersed in the medium (carrier) liquid, and therefore, image formation can be carried out by controlling particles with a particle size in a submicron order, and the liquid developing system is a promising developing method in terms of high image quality and high definition.

In the wet developing method, image formation is carried out by moving toner particles contained in the liquid developer to media by electrophoresis. In the wet developing method, specifically, in an opposing portion of a film forming electrode provided opposed to a developing roller, a developer containing an appropriate amount of the toner is formed in a film (layer) on the developing roller and a toner layer is formed on the developing roller by a squeeze roller. In a subsequent migration process, i.e., in respective processes of development, primary transfer and secondary transfer, basically, movement of all the toner (particles) is an image formation principal. Accordingly, on a density of an image formed on media, an application amount of the toner in the liquid developer formed in the film on the developing roller is reflected. Therefore, stable control of the application amount of the toner in the liquid developer carried on the developing roller is very important because the stable control leads to stabilization of an image quality over a long term.

As an image forming apparatus in which the application amount of the toner on the developing roller is controlled at a certain value, for example, an image forming apparatus including an optical sensor capable of detecting a surface of the developing roller has been known (see Japanese Laid-Open Patent Application (JP-A) Hei 10-268645). In this image forming apparatus, a liquid developer formed in a film on the developing roller under a predetermined condition is irradiated with light, and reflected light thereof is detected by the optical sensor, so that a concentration of the liquid developer is measured. Then, an acquired result is fed back to control of toner and carrier liquid amounts, a charge control agent amount and the like in a developing liquid tank, so that the application amount of the toner on the developing roller is controlled. According to this image forming apparatus, a concentration itself of the liquid developer on the developing roller is measured and is capable of being utilized in feed-back control, and therefore, as long as the measured developer concentration is proper, it is possible to stabilize the concentration of the liquid developer on the developing roller.

However, in the image forming apparatus of JP-A Hei 10-268645, the surface of the developing roller is measured utilizing the optical sensor, so that there is a possibility that the following problem occurs. That is by use of the image forming apparatus for a long period, surface roughness of the developing roller increases with the use and reflected light intensity changes, and therefore, there is a problem such that in a measuring method using the reflected light, it is difficult to detect the toner concentration of the liquid developer on the developing roller for the long period with high accuracy. For this reason, in the above-described image forming apparatus, due to a lowering in detection accuracy of the toner concentration of the liquid developer on the developing roller by the use thereof for the long period, it becomes difficult to carry out stable control of the toner concentration of the liquid developer formed in the film on the developing roller during image formation.

The present invention aims at providing an image forming apparatus capable of detecting a toner concentration of a liquid developer carried on a developing roller for a long period with high accuracy in the image forming apparatus using a liquid developing system.

Means for Solving the Problems

According to an aspect of the present invention, there is provided an image forming apparatus comprising: an image bearing member; a rotatable developing roller which includes an electroconductive layer containing an electroconductive agent and which carries a liquid developer containing toner and a carrier liquid, the developing roller developing an electrostatic latent image formed on the image bearing member, at a developing portion; an electrode portion, provided with a predetermined interval from the developing roller on a side upstream of the developing portion with respect to a rotational direction of the developing roller, for forming a potential difference between itself and the developing roller; an electroconductive roller, provided on a side upstream of the developing portion and downstream of the electrode portion with respect to the rotational direction of the developing roller, for urging the developing roller; first voltage applying means for generating a potential difference between the developing roller and the electrode portion; second voltage applying means for generating a potential difference between the developing roller and the electroconductive roller; current detecting means for detecting a current flowing through between the developing roller and the electroconductive roller; and a controller capable of controlling the first voltage applying means, wherein the controller controls the first voltage applying means so that by calculating information on a toner concentration in the liquid developer between the electroconductive roller and the developing roller from a detection result by the current detecting means when a predetermined potential difference is formed between the developing roller and the electroconductive roller in a state in which the liquid developer is applied onto the developing roller, the toner concentration is a target value.

Effect of the Invention

According to the present invention, the controller adjusts the toner concentration of the liquid developer on the surface of the developing roller by the toner concentration adjusting means depending on a change in detection result by the current detecting means when the predetermined potential difference is generated between the developing roller and the electroconductive member by the voltage applying means. For this reason, even when the developing roller is changed by the use of the image forming apparatus for the long period, compared with the case where a surface of the developing roller is detected by the optical sensor, detection accuracy is not remarkable lowered, so that the toner concentration can be always measured with high accuracy by reflecting such a successive change. By this, the toner concentration of the liquid developer carried on the developing roller can be detected for the long period with high accuracy.

EMBODIMENTS FOR CARRYING OUT THE INVENTION

First Embodiment

In the following, the First Embodiment of the present invention will be specifically described while making reference to FIGS. 1 to 8. An image forming apparatus 1 of this embodiment is a digital printer of an electrophotographic type in which a toner image formed using a liquid developer containing toner and a carrier liquid is formed on a recording material. In this embodiment, as an example of the image forming apparatus 1, a full-color printer of a tandem type is described. However, the present invention is not limited to the image forming apparatus 1 of the tandem type but may also be an image forming apparatus of another type. Further, the image forming apparatus is not limited to the image forming apparatus for a full-color image, but may also be an image forming apparatus for a monochromatic image or an image forming apparatus for a mono-color (single color) image. Or, the image forming apparatus can be carried out in various uses, such as printers, various printing machines, copying machines, facsimile machines and multi-function machines.

Figure 1:
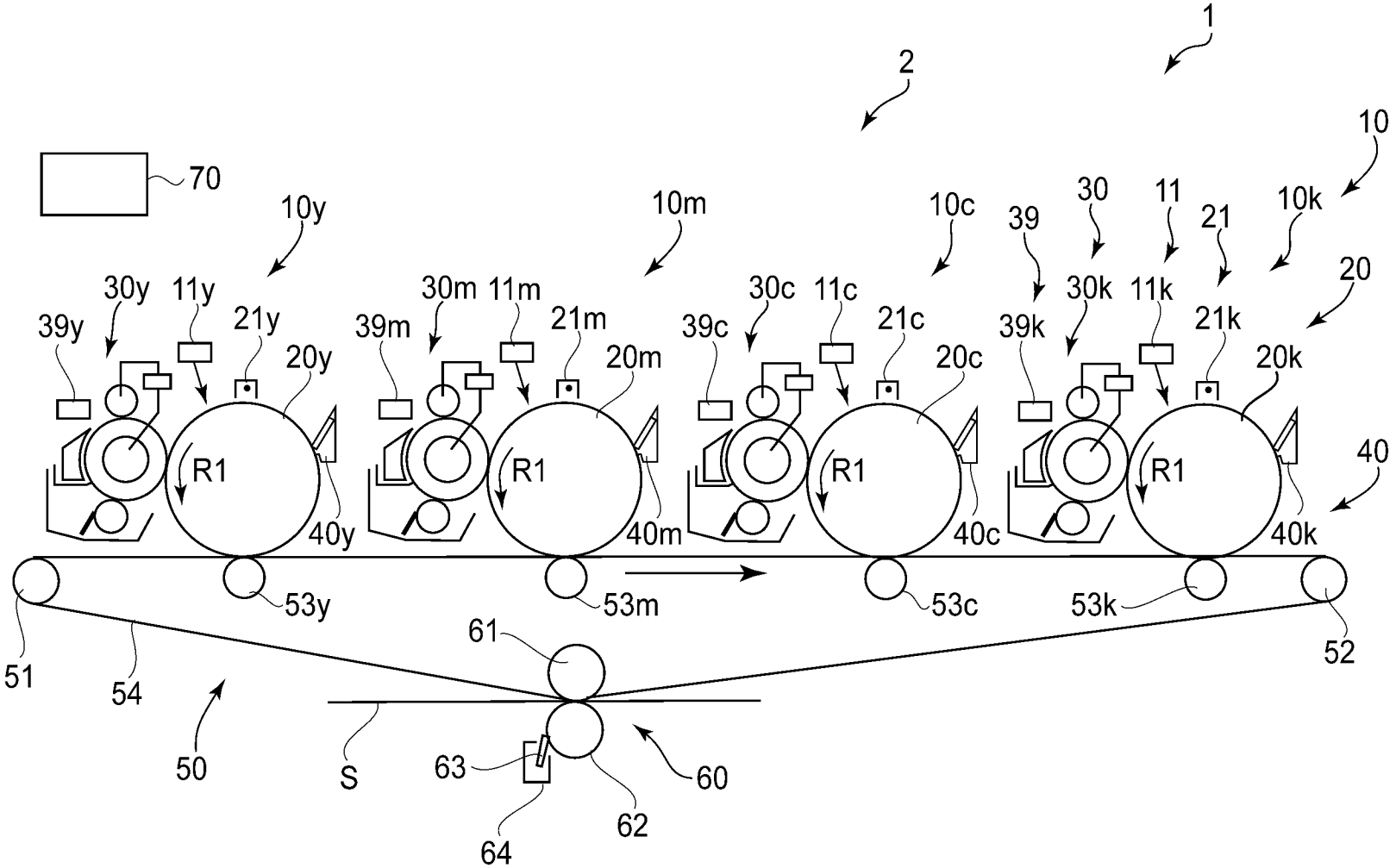
FIG. 1 is a schematic sectional view showing an image forming apparatus according to a First Embodiment.

As shown in FIG. 1, the image forming apparatus 1 includes an image forming portion 2 and a controller 70, and in addition, includes an unshown sheet feeding portion, an unshown sheet conveying portion and an unshown sheet discharging portion. Further, on a front-side upper surface of an apparatus main assembly of the image forming apparatus 1, for example, a display device 3 comprising a liquid crystal panel is provided (see FIG. 3). The image forming apparatus 1 is capable of forming a full-color image of four colors on the recording material depending on an image signal from an unshown original reading device, an unshown host device such as a personal computer, or an unshown external device such as a digital camera or a smartphone. Incidentally, on a sheet S as the recording material, the toner image is to be formed, and specific examples of the sheet S may include plain paper, a resin-made material sheet as a substitute for the plain paper, thick paper, a sheet for an overhead projector, and the like.

The image forming portion 2 includes image forming units 10*y*, 10*m*, 10*c*, 10*k*, a laser scanners 11*y*, 11*m*, 11*c*, 11*k*, an intermediary transfer unit 50, a secondary transfer unit 60 and an unshown fixing device. Incidentally, the image forming apparatus 1 in this embodiment meets full-color image formation, and the image forming units 10*y*, 10*m*, 10*c*, 10*k* have similar constitutions for four colors of yellow (y), magenta (m), cyan (c), black (k), respectively, and are separately provided. For this reason, in FIG. 1, respective constituent elements for the four colors are represented by adding identifiers for the colors subsequently to the same symbols, but in FIG. 2 and in the specification, are described using only the symbols without adding the identifiers for the colors in some cases.

The image forming unit 10 includes photosensitive drums (image bearing members) 20*y*, 20*m*, 20*c*, 20*k* moving while carrying toner images, chargers 21*y*, 21*m*, 21*c*, 21*k*, and developing devices 30*y*, 30*m*, 30*c*, 30*k*. Further, the image forming unit 10 includes developer mixers 39*y*, 39*m*, 39*c*, 39*k* and drum cleaners 40*y*, 40*m*, 40*c*, 40*k*. Similarly as the image forming unit 10, these have the same constitution for the four colors of yellow (y), magenta (m), cyan (c), black (k), respectively, and are separately provided. For this reason, in FIG. 1, respective constituent elements for the four colors are represented by adding the identifiers for the colors subsequently to the same symbols. The image forming unit 10 is integrally assembled into a unit as a cartridge and is constituted so as to be mountable in and dismountable from the apparatus main assembly of the image forming apparatus 1.

The photosensitive drum 20 is a drum-like electrophotographic photosensitive member including a cylindrical base material and a photosensitive layer which is formed on an outer peripheral surface of the base material and which is constituted by an organic photosensitive member or an amorphous silicon photosensitive member or the like, and is rotated about a center axis in an arrow R1 direction in the figures by an unshown drum motor. In this embodiment, as the photosensitive layer of the photosensitive drum 20, an amorphous silicon photosensitive layer is used. A width of the photosensitive drum 20 is made broader than a width of a developing roller (see FIG. 2) described later. The photosensitive drum 20 circulates and moves while carrying an electrostatic image formed on the basis of image information when an image is formed. The photosensitive drum 20 is movable while carrying a toner image formed using a liquid developer.

The charger 21 is provided substantially in parallel to the center axis of the photosensitive drum 20 and electrically charges a surface of the photosensitive drum 20 uniformly to a negative potential (dark portion potential) of the same polarity as negatively chargeable toner by a developing bias. Further, as the charger 21, a corona charger is used. However, as the charger 21, it is not limited to the corona charger, but a charging roller or the like may also be applied.

The laser exposure device 11 subjects the surface of the photosensitive drum 20 charged to the dark portion potential, to exposure by irradiation with laser light on a side downstream of the charger 21 with respect to an R1 direction and causes a potential drop to a light portion potential at an exposure portion, so that the electrostatic latent image is formed on the surface of the photosensitive drum 20. In this embodiment, the laser exposure device 11 irradiates the photosensitive drum surface with the laser light modulated depending on an image signal of an original, so that the laser light is projected onto the surface of the photosensitive drum 20 via an unshown polygon mirror, an unshown fθ lens and the like.

The developing device 30 is a device for developing the latent image, formed on the photosensitive drum 20, with liquid toner. Details of the developing device 30 will be described later. The developer mixer 39 supplies the liquid developer to the developing device 30 and includes a developer concentration sensor (toner concentration detecting means) 39*a* (see FIG. 2) capable of detecting the toner concentration of the liquid developer before being supplied to the developing roller 31. The developer concentration sensor 39*a* is, for example, a sensor utilizing light transmission and is used for calculating a weight percentage concentration (T/D) [wt. %] of the toner to the liquid developer supplied from the developer mixer 39. Incidentally, in this embodiment, the case where the developer concentration sensor 39*a* is a sensor utilizing light transmission was described, but the present invention is not limited thereto, and for example, a sensor utilizing an electric resistance or the like may also be used.

The drum cleaner 40 is disposed on a side downstream of a primary transfer portion described later with respect to the R1 direction and includes a cleaning blade 41 (see FIG. 2). The cleaning blade 41 is contacted to the photosensitive drum 20 at a predetermined angle and a predetermined pressure by an unshown pressing means, so that the liquid developer remaining on the photosensitive drum 20 is scraped off by the cleaning blade 41 and prepares for a subsequent process.

The intermediary transfer unit 50 includes a plurality of rollers such as a driving roller 51, a follower roller 52, and primary transfer rollers 53*y*, 53*m*, 53*c* and 53*k*, and includes the intermediary transfer belt 54 which is wound around these rollers and which is an endless belt for carrying the toner image. The primary transfer rollers 53*y*, 53*m*, 53*c*, 53*k* are disposed opposed to the photosensitive drums 20*y*, 20*m*, 20*c*, 20*k*, respectively, and contact the intermediary transfer belt 54, so that the toner images on the photosensitive drums 20 are primary-transferred onto the intermediary transfer belt 54 which is another image bearing member.

The intermediary transfer belt 54 forms the primary transfer portion between itself and the photosensitive drum 20 in contact with the photosensitive drum 20, and a primary transfer bias is applied to the intermediary transfer belt 54, whereby the toner image formed on the photosensitive drum 20 is primary-transferred at the primary transfer portion. A positive-polarity transfer bias is applied to the intermediary transfer belt 54 by the primary transfer rollers 53, whereby the toner images having the negative polarity on the photosensitive drums 20 are superposedly transferred successively onto the intermediary transfer belt 54.

The secondary transfer unit 60 includes a secondary transfer inner roller 61, a secondary transfer outer roller 62, an outer roller blade 63 and a cleaning liquid collecting portion 64. By applying a positive-polarity secondary transfer bias to the secondary transfer outer roller 62, a full-color toner image formed on the intermediary transfer belt 54 is transferred onto the sheet S. The secondary transfer outer roller 62 forms the secondary transfer portion between itself and the intermediary transfer belt 54 in contact with the intermediary transfer belt 54, and a secondary transfer bias is applied to the secondary transfer outer roller 62, whereby the toner images, primary-transferred on the intermediary transfer belt 54, are secondary-transferred onto the sheet S by the secondary transfer unit 60.

The unshown fixing portion includes a fixing roller and a pressing roller, and the sheet S is nipped and fed between the fixing roller and the pressing roller, so that the toner images transferred on the sheet S are pressed and heated and thus are fixed on the sheet S.

Figure 2:
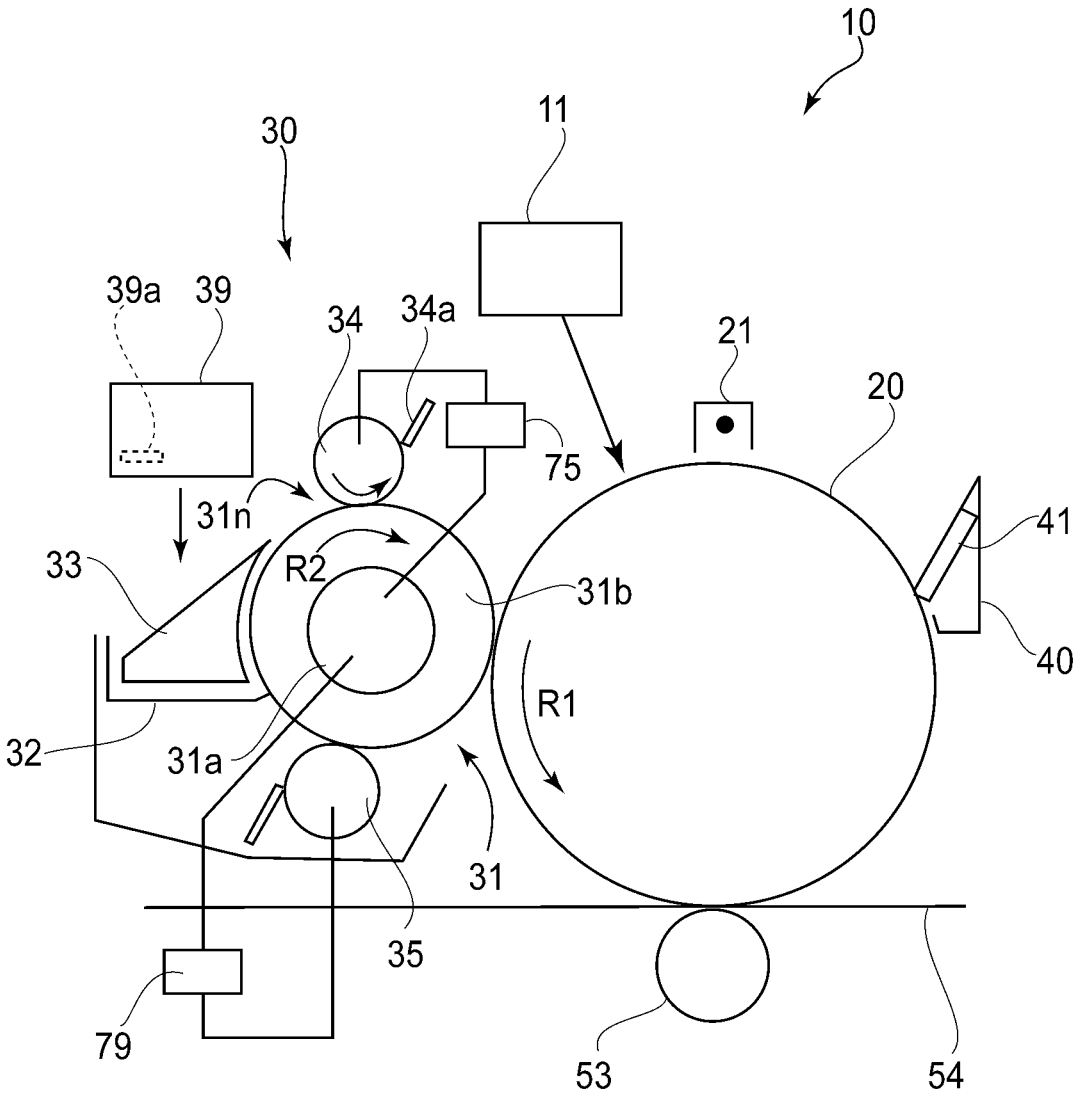
FIG. 2 is a schematic sectional view showing an image forming unit of the image forming apparatus according to the First Embodiment.

Next, a constitution of the developing device 30 in this embodiment will be specifically described using FIG. 2. The developing device 30 includes the developing roller 31 for feeding the liquid developer toward the photosensitive drum 20 while carrying the liquid developer, a developing liquid tank 32, a film forming electrode (electrode portion) 33, a squeeze roller (electroconductive member) 34 and a cleaning roller 35.

The developing roller 31 is a cylindrical member of 45 mm in diameter and rotates about a center shaft 31*a* in a rotational direction R2. The developing roller 31 includes a 5 mm-thick surface layer 31*b* formed of an elastic member by an electroconductive polymer or the like on an outer peripheral portion of the center shaft 31*a* which is an inner core made of metal such as stainless steel. The developing roller 31 is disposed opposed to the photosensitive drum 30 so as to form a number between itself and the photosensitive drum 20, and at the nip, a developing nip is formed. In this embodiment, the surface layer 31*b* of the developing roller 31 is made of an electroconductive urethane rubber, and in an initial state, inside the surface layer 31*b*, an ion conductive agent is uniformly dispersed, so that volume resistivity is adjusted. Incidentally, the volume resistivity of the developing roller 31 used in this embodiment is $1\times10^{2}$-$1\times10^{12}$ Ω·cm inclusive of a variation. That is, the developing roller 31 is rotatable while carrying the liquid developer containing the toner and the contact, and contains the electroconductive agent. Incidentally, to the developing roller 31, a developing roller voltage source 73 (see FIG. 3) capable of applying a voltage is connected.

As a material of the surface layer 31*b* of this developing roller 31, for example, the following materials are applied. First, an appropriate resin is selected from EPDM, urethane, silicone, nitrile-butadiene rubber, chloroprene rubber, styrene-butadiene rubber, butadiene rubber, and the like. Then, into this selected resin, as an electric resistance adjusting material, electroconductive particles, for example, either one or a plurality of carbon (back) and titanium oxide are used, and are dispersed and mixed, and it is appropriate to use a material based on a dispersion-type resistance-adjusting resin. Further, in the case where a foaming material is used as a foaming and mixing step for obtaining elasticity, it is appropriate to use a silicone-based surfactant (for example, polydiallylsiloxane, polysiloxane-polyalkyleneoxide block copolymer).

The developing liquid tank 32 is disposed on a side substantially opposite from the photosensitive drum with the developing roller 31 as a center, and accommodates the liquid developer for developing the latent image formed on the photosensitive drum 20. The liquid developer used in this embodiment is formed by adding particles of 0.8 μm in average particle size of a colorant such as a pigment into a polyester-based resin, together with a dispersing agent, a toner charge control agent and a charge directing agent into the liquid carrier such as an organic solvent of an isoparaffine type. Further, the liquid developer in this embodiment is about 7 wt. % in concentration of the toner particles. Incidentally, in this embodiment, the surfaces of the toner particles are charged to the negative polarity in a certain amount.

The film forming electrode 33 contacts the liquid developer stored in the developing liquid tank 32 and is disposed closed and opposed to the developing roller 31 with a gap from the developing roller 31. The liquid developer enters between the film forming electrode 33 and the developing roller 31, and the liquid developer is formed in a film (layer) on the developing roller 31, and in addition, a potential difference is set between the film forming electrode 33 and the developing roller 31, whereby a toner concentration of the liquid developer on the surface of the developing roller 31 is adjustable. In this embodiment, the potential difference between the film forming electrode 33 and the developing roller 31 is adjusted so that the toner concentration of the liquid developer after passing through the film forming electrode 33 is 13.0±3.0 wt. %.

The squeeze roller 34 is disposed on a side downstream of the film forming electrode 33 with respect to a rotational direction R2 and is disposed in contact with the developing roller 31 through at least the carrier liquid. The squeeze roller 34 shifts the toner particles, contained in the liquid developer formed in a film (layer) on the developing roller, toward the developing roller 31 side by application of a voltage, and in addition, an excessive carrier liquid is squeezed and collected, so that the concentration of the liquid developer carried on the developing roller 31 is adjustable. The squeeze roller 34 is a cylindrical member made of metal in a diameter of 40 mm, and in this embodiment, a roller prepared by a stainless steel is used. The squeeze roller 34 is contacted to the developing roller 31 so that a pressure is constant (almost 80 kPa in this embodiment) over a longitudinal length of almost 300 mm, and rotates about a center axis in an arrow direction. Incidentally, to the squeeze roller 34, a squeeze roller voltage source 74 (see FIG. 3) capable of applying a voltage is connected.

The liquid developer which is drawn up from the developing liquid tank 32 and which passed toner the film forming electrode 33 is carried on the developing roller 31 in a certain amount. For that reason, the liquid developer fed at a predetermined speed to a contact portion between the squeeze roller 34 and the developing roller 31 stably forms a nip 31*n* of almost 6 μm in gap and almost 5 mm in width. The liquid developer is adhered to and separated from the respective rollers 34 and 31 on an open side of the nip 31*n* between the squeeze roller 34 and the controller 31. As described later, a predetermined potential difference is set between both the rollers 34 and 31 so as to perform an operation in which the toner shifts toward the developing roller 31 side. For this reason, the toner concentration in the liquid developer at the surface of the developing roller 31 after passing through between the rollers 34 and 31 is about twice the toner concentration before passing through between the rollers 34 and 31, i.e., 26.0±6.0 wt. %.

The cleaning roller 35 is disposed in contact with the developing roller 31 on a side downstream of the developing nip between the developing roller 31 and the photosensitive drum with respect to the rotational direction R2. The cleaning roller 35 is a roller made of metal or the like, and removes the liquid developer, carried and remaining on the surface of the developing roller 31, in contact with the developing roller 31.

Figure 3:
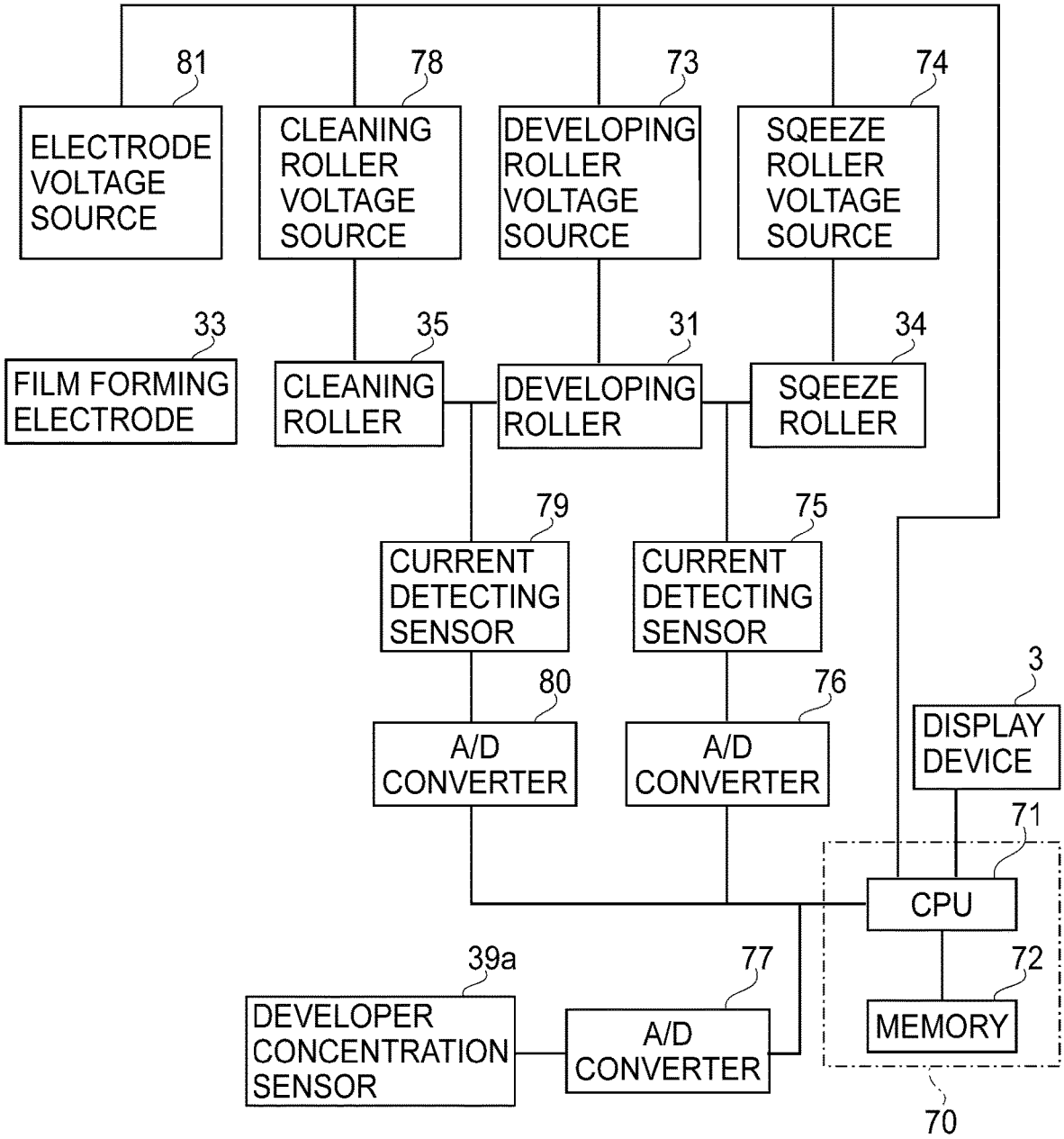
FIG. 3 is a schematic illustration showing a control block diagram of the image forming apparatus according to the First Embodiment.

As shown in FIG. 3, the controller 70 is constituted by a computer and is provided with, for example, a CPU 71, a memory 72 and an unshown input and output circuit for inputting and outputting signals between itself and an outside portion. The memory 72 includes a ROM for storing programs for controlling respective portions and includes a RAM for temporarily storing data. The CPU 71 is a microprocessor managing entirety of control of the image forming apparatus 1 and is a main body of a system controller. The CPU 71 is connected to the respective portions of the image forming apparatus 1, such as the image forming portion 2, through the input and output circuit, and not only transfers the signals between itself and the respective portions but also controls operations of the respective portions. In the ROM of the memory 72, an image formation control sequence for forming the image on the sheet S and the like are stored.

To the developing roller 31, a developing roller voltage source (voltage applying means) 73 is connected, and to the film forming electrode 33, an electrode voltage source 81 (first voltage applying means) is connected, and to the squeeze roller 34, a squeeze roller voltage source (second voltage applying means) 74 is connected, and to the cleaning roller 35, a cleaning roller voltage source 78 is connected. These voltage sources 73, 74 and 78 are connected to the CPU 71 and are controlled by the CPU 71, so that a potential difference is capable of being generated between the developing roller 31 and the squeeze roller 34 or the cleaning roller 35. Further, between the developing roller 31 and the squeeze roller 34, a current detecting sensor (current detecting means) 75 for detecting a current passing through between these developing roller 31 and squeeze roller 34 is provided. A signal detected by this current detecting sensor 75 is inputted to the CPU 71 through an A/D converter 76. Between the developing roller 31 and the cleaning roller 35, a current detecting sensor 79 for detecting a current flowing through between the developing roller 31 and cleaning roller 35 is provided. A signal detected by this current detecting sensor 79 is inputted to the CPU 71 through an A/D converter 80. Further, a signal detected by the developer concentration sensor 39*a* of the developer mixer 39 is inputted to the CPU 71 through an A/D converter 77.

The controller 70 is capable of controlling the respective voltage sources 73, 74, 78 and 81. Further, the controller 70 adjusts the toner concentration of the liquid developer on the surface of the developing roller 31 by the film forming electrode 33 depending on a change in detection result by the current detecting sensor 75 when a predetermined potential difference is generated between the developing roller 31 and the squeeze roller 34 by the voltage sources 73 and 74.

In this embodiment, the controller 70 is capable of executing a first mode and a second mode in a switching manner. In the first mode, the controller 70 causes the developing roller 31 to carry a reference liquid developer having a known toner concentration and causes the respective voltage sources 73 and 74 to generate a potential difference, and calculates a resistance value of the developing roller 31 on the basis of a detection result by the current detecting sensor 75. In the second mode, the controller 70 causes the voltage sources 73 and 74 to generate a potential difference and calculates the toner concentration of the liquid developer on the surface of the developing roller 31 on the basis of the detection result by the current detecting sensor 75 and the resistance value of the developing roller 31. Then, the controller 70 adjusts the toner concentration of the liquid developer on the surface of the developing roller 31 by the film forming electrode 33 depending on the toner concentration of the liquid developer calculated by executing the second mode during image formation. In this embodiment, the controller 70 acquires the known toner concentration of the reference liquid developer by detecting the toner concentration of the reference liquid developer by the developer concentration sensor 39*a*.

Here, in the present specification, during image formation is the time (period) in which the toner image is formed on the photosensitive drum 20 on the basis of image information inputted from a scanner provided to the image forming apparatus 1 or from an external terminal such as a personal computer. Further, during non-image formation is the time (period) other than during image formation, and for example, before execution or after execution of an image forming job after main switch actuation, during pre-rotation, a sheet interval, during post-rotation in the image forming job, and the like. Incidentally, the image forming job is the following series of operations performed on the basis of a print instruction signal (image formation instruction signal). That is, the image forming job is the series of operations from a start of a preparatory operation (pre-rotation) necessary for carrying out the image formation until a preparatory operation (post-rotation) necessary for ending the image formation is completed through an image forming step. The sheet interval is a period corresponding to an interval between a toner image formed on a single sheet and a toner image formed on a subsequent single sheet in the case where the image formation is continuously carried out.

Next, an operation of the image forming apparatus 1 using the above-described developing device will be described using FIG. 2 and FIG. 3. To the developing roller 31, a voltage of −400 V is applied by the developing roller voltage source 73. The toner concentration of the liquid developer in the developing liquid tank 32 is adjusted to about 5 wt. % in the developer mixer 39, and the toner particles have negative electric charges. On the surface of the developing roller 31, the liquid developer is carried when the developing roller surface passes from the developing liquid tank 32 to the film forming electrode 33. At this time, to the film forming electrode 33, a voltage of −550 to −600 V is applied from the voltage source which is a voltage applying means, so that most of the toner particles are attracted to the surface of the developing roller 31 by the potential difference between itself and the developing roller 31. The liquid developer is separated into a liquid developer carried by the surface of the developing roller 31 and a liquid developer flowing down to a rear surface of the film forming electrode 33 in the neighborhood of an exit between the developing roller 31 and the film forming electrode 33. At this time, the toner concentration of the liquid developer on the surface of the developing roller 31 is 10 to 15 wt. %.

The liquid developer deposited on and carried by the surface of the developing roller 31 reaches the squeeze roller 34. To the squeeze roller 34, a voltage higher than the applied voltage of the developing roller 31 by 50 to 120 V is applied from the squeeze roller voltage source 74. That is, for example, when the applied voltage of the developing roller 31 is −400 V, the applied voltage of the squeeze roller 34 is −450 V to −520 V.

Figure 4:
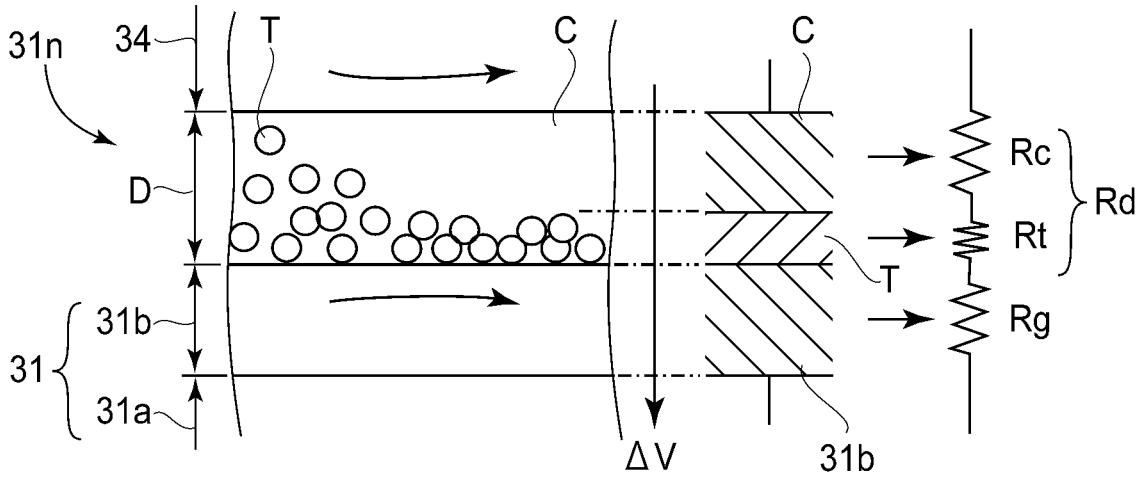
FIG. 4 is a schematic enlarged view showing a nip between a developing roller and a squeeze roller of the image forming apparatus according to the First Embodiment.

Here, motion of the toner in the nip 31*n* between the developing roller 31 and the squeeze roller 34 will be described using FIG. 4. The toner T contained in the liquid developer D carried on the developing roller 31 moves, during passing through between the nip 31*n* with the squeeze roller 34, toward the developing roller 31 side by the potential difference generated between the rollers 31 and 34. When the liquid developer D passes through between the squeeze roller 34 and the developing roller 31, the liquid developer D is deposited on and separated by both the rollers 34 and 31. At this time, the toner concentration of the liquid developer carried on the developing roller 31 is 25 to 35 wt. %. On the other hand, the toner T is little attracted toward the squeeze roller 34, so that the carrier liquid C in which a content of the toner T is remarkably small is carried. As shown in FIG. 2, the carrier liquid carried by the squeeze roller 34 is scraped off and removed from the surface of the squeeze roller 34 by a squeeze roller blade 34*a* constituted by a rubber or the like in contact with the surface of the squeeze roller 34. The liquid developer carried by the surface of the developing roller 31 reaches the photosensitive drum 20.

The photosensitive drum 20 is charged to almost −600 V by applying a voltage of about −4.5 kV to −5.5 kV to a wire of the charger 21 on an upstream side of the developing nip with the developing roller 31. After charging, the latent image is formed so that a potential of an image portion is almost 200 V by the laser exposure device 11.

In the developing nip formed between the developing roller 31 and the photosensitive drum 20, the toner particles move in the following manner. The toner particles selectively move toward the image portion on the photosensitive drum 20 in accordance with an electric field formed by a bias of −400 V applied to the developing roller 31 and the latent image (image portion: −200 V, non-image portion: −800 V) on the photosensitive drum 20. By this, the toner image is formed on the photosensitive drum 20. The carrier liquid is not influenced by the electric field, and therefore, is separated at the exit of the developing nip between the developing roller 31 and the photosensitive drum 20 and is deposited on both the developing roller 31 and the photosensitive drum 20.

The toner image passed through the developing nip on the photosensitive drum 20 reaches a nip with the intermediary transfer belt 54, so that primary transfer is carried out. To the primary transfer roller 53, a voltage of about +200 V of an opposite polarity to a charging characteristic of the toner particles is applied, so that the toner on the photosensitive drum 20 is primary-transferred onto the intermediary transfer belt 54 and only the carrier liquid remains on the photosensitive drum 20. The carrier liquid remaining on the photosensitive drum 20 is scraped off by the cleaning blade 41 disposed downstream of the primary transfer portion and is collected by the drum cleaner 40.

The toner images primary-transferred onto the intermediary transfer belt 54 at the primary transfer portions are moved toward the secondary transfer unit 60 as shown in FIG. 1. In the secondary transfer unit 60, to the secondary transfer outer roller 62, a voltage of +1000 V is applied and the secondary transfer inner roller 61 is maintained at 0 V, so that the toner particles on the intermediary transfer belt 54 are secondary-transferred onto the sheet S. Incidentally, the liquid developer remaining on the intermediary transfer belt 54 after secondary transfer is collected by an unshown intermediary transfer belt cleaning member.

In an image forming process by the image forming apparatus 1 of this embodiment, movement (transfer) efficiency in each of toner moving processes is required to be almost 95% or more, which is very high. For that reason, during image formation, in each of the developing devices 30, it is important for stabilizing an image quality of the images outputted on the sheets S that an amount of the toner contained in the liquid developer on the developing roller 31 at a position in front of the photosensitive drum 20 is stabilized with accuracy.

Therefore, in the image forming process by the image forming apparatus 1 of this embodiment, in each of the developing devices 30, the following procedure is executed for detecting the toner concentration with high accuracy. Here, in each of the image forming units 10, a current generating when a certain voltage is applied between the squeeze roller 34 and the developing roller 31 is measured, and the toner concentration of the liquid developer carried on the developing roller 31 is discriminated on the basis of a result of the measurement.

Figure 5:
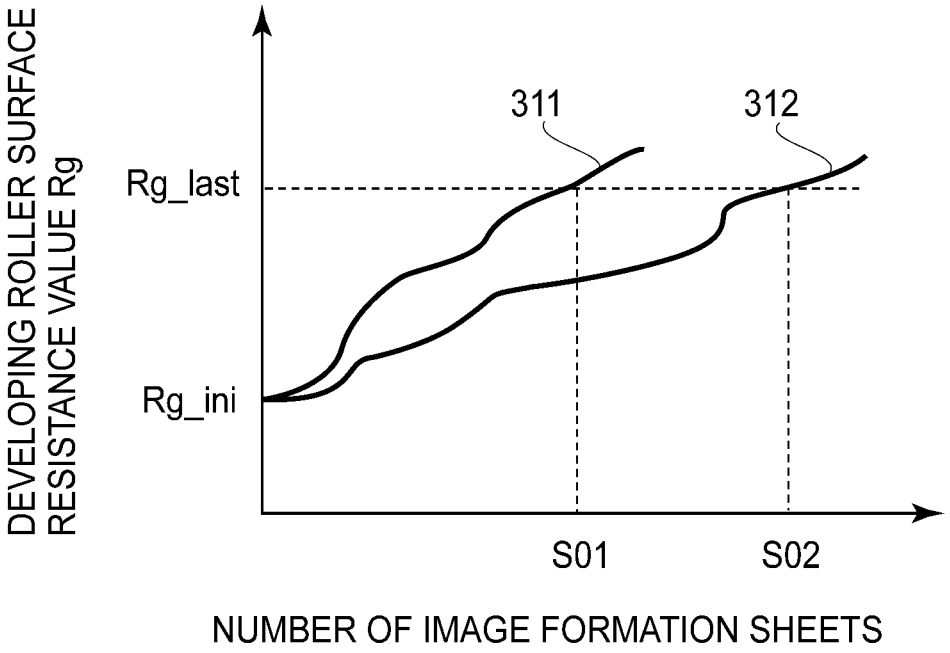
FIG. 5 is a graph showing a relationship between a number of image formation sheets and a resistance value of a surface layer of the developing roller in the image forming apparatus according to the first Embodiment.

However, as described above, the volume resistivity of the surface layer 31*b* of the developing roller 31 is optimized by dispersing and mixing the ion conductive agent. However, with use of the developing roller 31, the ion conductive agent originally dispersed uniformly in the surface layer 31*b* causes localization, so that the volume resistivity of the surface layer 31*b* gradually increases. Accordingly, the electric resistance of the surface layer 31*b* of the developing roller 31 measured under a certain condition gradually increases with an increase in number of image formation sheets, for example, as shown in FIG. 5. Incidentally, in FIG. 5, Rg_ini is the resistance value Rg of the surface layer 31*b* of the developing roller 31 before use, and Rg last is the resistance value Rg of the surface layer 31*b* of the developing roller 31, discriminated as being, an end of the lifetime. In order to discriminate the toner concentration of the liquid developer carried on the developing roller 31 by the above-described method, there is a need to detect the resistance value Rg of the surface layer 31*b* of the developing roller 31.

In this embodiment, the liquid developer having a known toner concentration is periodically carried on the developing roller 31, and the electric resistance of the surface layer 31*b* of the developing roller 31 is acquired in advance on the basis of a combination of a current generating during application of a certain voltage between the squeeze roller 34 and the developing roller 31 with information on the toner concentration. Then, by using a result thereof, discrimination of the toner concentration of the developer carried on the developing roller 31 during image formation is made. In the following, first, the first mode in which the reference liquid developer having the known toner concentration is carried on the developing roller 31 and the potential difference is generated by the voltage sources 73 and 74, and the resistance value Rg of the developing roller 31 is calculated on the basis of a detection result by the current detecting sensor 75 will be described. Substantially, the second mode in which the potential difference is generated by the voltage sources 73 and 74, and the toner concentration of the liquid developer on the surface of the developing roller 31 is calculated on the basis of the detection result by the current detecting sensor 75 and the resistance value Rg of the developing roller 31 will be described.

First, the first mode will be described. As shown in FIG. 4, in the nip 31*n* between the developing roller 31 and the squeeze roller 34, the squeeze roller 34 and the center shaft 31*a* of the developing roller 31 are made of metal and their resistance values are very small. On the other hand, the surface layer 31*b* of the developing roller 31 comprises an electroconductive polymer in which volume resistivity is adjusted, and includes a resistance component (resistance value Rg). Further, the liquid developer D existing between the developing roller 31 and the squeeze roller 34 includes a resistance component (resistance value Rc) in the carrier liquid C and a resistance component (resistance value Rt) in the toner T. On the basis of this, the liquid developer D and the surface layer 31*b* of the developing roller 31 can be represented as an equivalent circuit including the respective resistance components.

Here, the case where a certain voltage ΔV is applied to between the squeeze roller 34 and the developing roller 31 will be considered. The equivalent circuit shown in FIG. 4, a current I flowing between both the rollers 34 and 31 is determined by a total value of the resistance value Rg of the surface layer 31*b* of the developing roller 31, the resistance value Rc by the carrier liquid C and the resistance value Rt by the toner T. When the resistance value Rd of the liquid developer D is Rd=Rc+Rt, the resistance value Rg of the surface layer 31*b* of the developing roller 31 can be calculated using the following symbolic formula 1.

$$Rg=(\Delta V/I)-Rd \tag{1}$$

Figure 6:
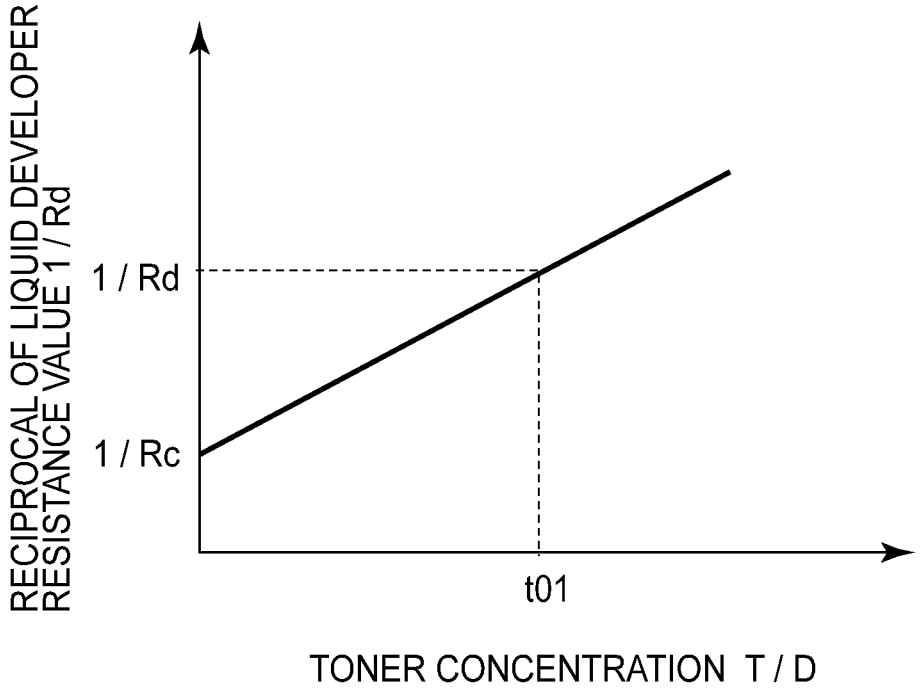
FIG. 6 is a graph showing a relationship between a toner concentration of a liquid developer and the reciprocal of a resistance value of the liquid developer in an image forming apparatus according to the First Embodiment.

From the symbolic formula 1, when the resistance value Rd of the liquid developer D is known, the current I flowing between both the rollers 34 and 31 is detected by applying the predetermined voltage ΔV to between the squeeze roller 34 and the developing roller 31, so that the resistance value Rg of the surface layer 31*b* of the developing roller 31 can be calculated. Incidentally, here, the resistance value Rg is calculated by utilization of the liquid developer, but the present invention is not limited thereto, and the resistance value Rg may also be calculated by utilization of the carrier liquid in place of the liquid developer. In this case, the resistance value Rc of the carrier liquid is acquired in advance and is utilized. In the liquid developer, electrical conductivity (reciprocal of volume resistivity) of the toner particles is about $10^2$ times that of the carrier liquid. Electrical conductivity of the liquid developer increases substantially in proportion to a weight percentage concentration (T/D) [wt. %] of the toner occupied in the entirety of the liquid developer, and therefore, the reciprocal 1/Rd of the resistance value of the developer measured by the method of this embodiment linearly increases relative to T/D of the developer as shown in FIG. 6. For that reason, when a slope of dependency of 1/Rd on T/D is a, the resistance value Rd of the developer is represented by the following symbolic formula.

$$Rd=1/\{(1/Rc)+a\cdot(T/D)\} \tag{2}$$

In this embodiment, the resistance value Rc of the carrier liquid and the slope a of the dependency of 1/Rc on T/D are grasped in advance. Further, T/D of the liquid developer in the developing liquid tank 32 is detected, as that of the reference liquid developer having the concentration which is known, using the developer concentration sensor 39*a*. Further, this is achieved by carrying out film formation of the liquid developer on the developing roller 31 without changing the concentration of the liquid developer in the developing liquid tank 32 by setting voltages so that the film forming electrode 33 and the developing roller 31 have the same potential. By these, the resistance value Rd of the liquid developer can be calculated using the symbolic formula 2, and from the resultant resistance value Rd of the liquid developer and the current I between the squeeze roller 34 and the developing roller 31, the resistance value Rg of the surface layer 31*b* of the developing roller 31 is calculated using the symbolic formula 1. Incidentally, the volume resistivity of the carrier liquid used in this embodiment is about $1\times10^{8}$-$1\times10^{13}$ Ω·cm, and the resistance value measured in the system in this embodiment is about $1\times10^{7}$Ω. Further, the volume resistivity of the toner particles is $1\times10^{12}$-$1\times10^{14}$ Ω·cm.

Figure 7:
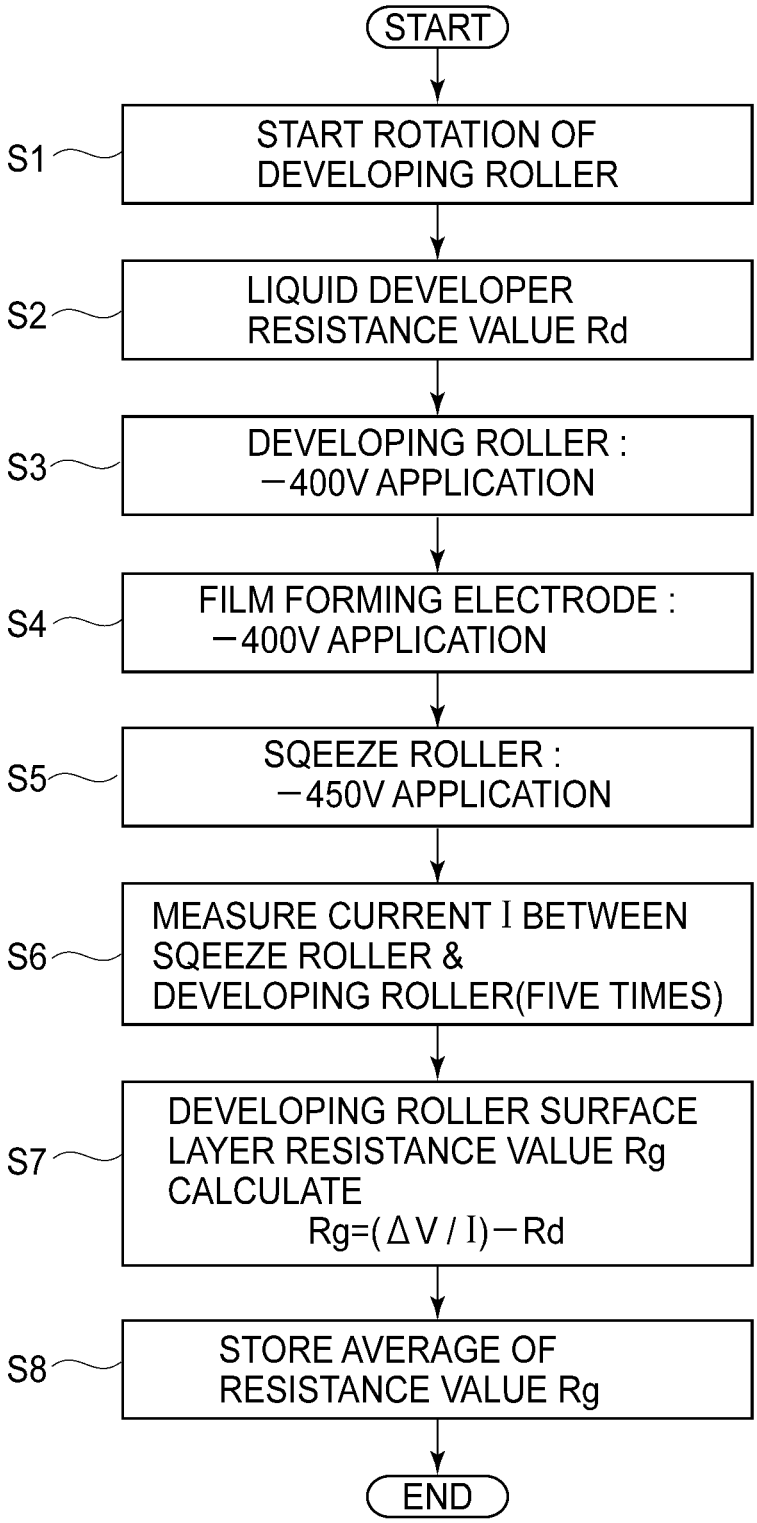
FIG. 7 is a flowchart showing a process procedure of the first mode in the image forming apparatus according to the First Embodiment.

Next, a process procedure of the first mode in which the resistance value of the surface layer 31*b* of the developing roller 31 is measured will be described along a flowchart shown in FIG. 7. Incidentally, the resistance value Rg of the surface layer 31*b* of the developing roller 31 gently changes relative to a use time and a frequency of the developing roller 31. For that reason, execution of the first mode may preferably be carried out at timing such as the time of a start of business operations of a day or after formation of many images or the like. Further, until the first mode is subsequently carried out, a value of the resistance value Rg measured and stored in the last first mode is used. Incidentally, in this embodiment, the first mode is executed at the time of main switch actuation of the image forming apparatus 1 every morning.

After the start of the first mode, the controller 70 starts rotation of the developing roller 31 (step S1). In this embodiment, a peripheral speed of the developing roller 31 is 785 mm/s. At this time, the squeeze roller 34 is contacted to the developing roller 31 through the liquid developer and rotates at the same speed as the developing roller 31.

The controller 70 detects T/D of the liquid developer in the developing liquid tank 32 by using the developer concentration sensor 39*a*, and calculates the resistance value Rd of the developer from the symbolic formula 3 by utilizing the known resistance value Rc of the carrier liquid and the slope a of 1/Rd vs. T/D (step S2). That is, the controller 70 acquires the known toner concentration of the liquid developer by detecting the toner concentration of the liquid developer (reference liquid developer) by the developer concentration sensor 39*a*. The controller 70 applies a voltage of −400 V to the developing roller 31 (step S3), and applies a voltage of −400 V, which is equal to the potential of the developing roller 31, to the film forming electrode 33 (step S4). At this time, the film forming electrode 33 has no potential difference relative to the developing roller 31, and therefore, the toner contained in the liquid developer passing through therebetween is not electrically shifted toward either of the members, and passes through between the developing roller 31 and the film forming electrode 33 while T/D of the developer is kept uniform and is separated. Therefore, T/D of the developer subsequently passing and reaching the nip 31*n* between the squeeze roller 34 and the developing roller 31 is equal to T/D of the developer in the developing liquid tank 32.

The controller 70 applies a voltage of −450 V to the squeeze roller 34 (step S5), and measures a current I generated between the squeeze roller 34 and the developing roller 31 by the current detecting sensor 75 (step S6). The controller 70 continuously repeats measurement of the current I five times in total at a rate of once per (one) sec. The measured current I is sent as digital information to the CPU 71 through the A/D converter 76. The CPU 71 makes reference to the resistance value Rd calculated in the step S2, and calculates the resistance value Rg of the surface layer 31*b* of the developing roller 31 by using the symbolic formula 2 (step S7). Thereafter, the controller 70 calculates an average of the resistance values, Rg of the surface layer 31*b* of the developing roller 31, which are calculated continuously five times, and stores the calculated average as the resistance value Rg of the surface layer 31*b* of the developing roller 31 in a memory 91 at that time (step S8). Then, the controller 70 ends the process of the first mode.

Next, the second mode will be described. Here, again by making reference to FIG. 4, an equivalent circuit of an electric resistance constituted by the liquid developer and the surface layer 31*b* of the developing roller 31 in the nip 31*n* between the developing roller 31 and the squeeze roller 34 will be considered. In the case where the current I flowing through between both the rollers 31 and 34 is measured under application of a certain voltage ΔV to between the squeeze roller 34 and the developing roller 31, the resistance value Rd=Rc+Rt of the liquid developer is represented by a symbolic formula 3 with use of the symbolic formula 1.

$$Rd=(\Delta V/I)-Rg \tag{3}$$

Therefore, when the resistance value Rg of the surface layer 31*b* of the developing roller 31 is known, the resistance value Rd of the liquid developer carried on the surface layer 31*b* of the developing roller 31 is acquired from the applied voltage ΔV between the developing roller 31 and the squeeze roller 34 and from the generated current I. In this embodiment, the resistance value Rg stored in the first mode can be used. Further, a relationship between the toner concentration T/D in the liquid developer and the resistance value Rd of the liquid developer is represented as shown in a symbolic formula 4 with use of the symbolic formula 2 from the known resistance value Rc of the carrier liquid and the known coefficient a.

$$T/D=(1/a)((1/Rd)-(1-Rc)) \tag{4}$$

Figure 8:
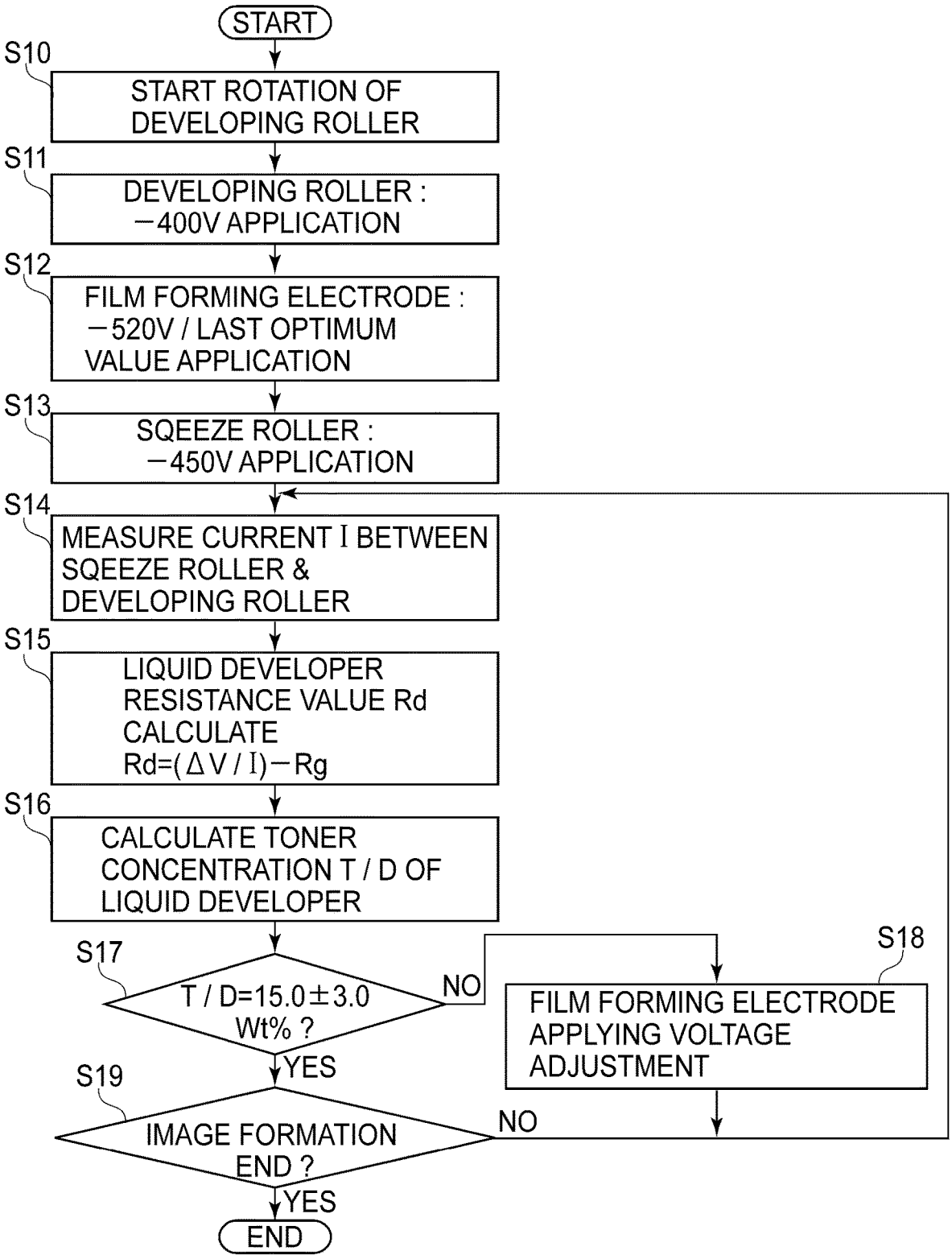
FIG. 8 is a flowchart showing a process procedure of a second mode in the image forming apparatus according to the First Embodiment.

Next, a process procedure of the second mode in which the toner concentration of the liquid developer carried on the developing roller 31 is calculated from the resistance value Rg of the surface layer 31*b* of the developing roller 31 will be described along a flowchart shown in FIG. 8. Here, description will be made inclusive of a process procedure in which after execution of the second mode, the toner concentration of the liquid developer carried on the developing roller 31 between the film forming electrode 33 and the developing roller 31 by feeding the calculated toner concentration back to a voltage to be applied to the film forming electrode 33. That is, the controller 70 adjusts the toner concentration of the liquid developer on the surface of the developing roller 31 by the film forming electrode 33 depending on the toner concentration of the liquid developer calculated by executing the second mode during image formation.

After the start of the second mode, the controller 70 causes the developing roller 31 to start rotation (step S10). In this embodiment, the peripheral speed of the developing roller 31 is 785 mm/s. At this time, the squeeze roller 34 is contacted to the developing roller 31 through the liquid developer and rotates at the same speed as the developing roller 31. Subsequently, the controller 70 causes the voltage source to apply a voltage of −400 V to the developing roller 31 (step S11).

Then, the controller 70 causes the voltage source to apply a voltage of −520 V to the film forming electrode 33 in an initial stage and to apply a voltage last optimized in other cases (step S12). At this time, a part of the negatively chargeable toner dispersed in the liquid developer is attracted toward the developing roller 31 side by the potential difference between the developing roller 31 and the film forming electrode 33. Incidentally, T/D of the liquid developer supplied to the developing liquid tank 32 is controlled so as to be 7.5±2.5 wt. % by using the developer concentration sensor 39*a* provided in the developer mixer 39. In this case, in an initial state, the potential difference of the film forming electrode 33 relative to the developing roller 31 is −120 V, and T/D in the liquid developer carried on the developing roller 31 is 15.0±3.0 wt. %. However, with use of the image forming apparatus 1, these are not limited thereto due to an excessive increase in T/D of the liquid developer in the developing liquid tank 32, resistivity of the surface layer 31*b* of the developing roller 31, and the like.

In this state, the controller 70 causes the voltage source to apply a voltage of −450 V to the squeeze roller 34 (step S13). At this time, the squeeze roller 34 has a potential difference of −50 V relative to the developing roller 31, and the current I flowing from the developing roller 31 toward the squeeze roller 34 is measured by the current detecting sensor 75 (step S14). At this time, the liquid developer between both the rollers 31 and 34 and the surface layer 31*b* of the developing roller 31 act as resistors (respective electric resistances are Rd and Rg).

The acquired current I between the developing roller 31 and the squeeze roller 34 is sent as digital information to the CPU 71 through the A/D converter 76. The CPU 71 makes reference to the resistance value Rg stored in the memory 72 in the first mode, and calculates the resistance value Rd of the liquid developer carried on the developing roller 31 between both the rollers 31 and 34 by using the symbolic formula 3 (step S15). Then, the controller 70 calculates the toner concentration of the liquid developer through the symbolic formula 4 by using the calculated resistance value Vd of the liquid developer, the known resistance value Rc of the carrier liquid and the coefficient a (step 16).

In this embodiment, a target range of T/D of the liquid developer on the developing roller 31 is 15.0±3.0 wt. %. Therefore, the controller 70 discriminates whether or not T/D of the liquid developer actually carried on the developing roller 31 falls within the target range (step S17). In the case where the controller 70 discriminated that T/D of the liquid developer carried on the developing roller 31 does not fall within the target range, the controller 70 adjusts T/D of the liquid developer on the developing roller 31 by optimizing the voltage to be applied to the film forming electrode 33 (step S18). The controller 70 causes the current detecting sensor 75 to measure the current I flowing from the developing roller 31 toward the squeeze roller 34, again after adjusting the voltage to be applied to the film forming electrode 33 (step S14). In the case where the controller 70 discriminated that T/D of the liquid developer carried on the developing roller 31 falls within the target range, the procedure goes to subsequent image formation without changing the voltage to be applied to the film forming electrode 33. Further, the controller 70 discriminates whether or not the image formation is ended (step S19), and in the case where the controller discriminated that the image formation does not end, the controller 70 causes again the current detecting sensor 75 to measure the current I flowing from the developing roller 31 toward the squeeze roller 34 (step S14). On the other hand, in the case where the controller 70 discriminated that the image formation ends, the controller 70 ends the process of the second mode.

As described above, according to the image forming apparatus 1 of this embodiment, the controller 70 causes the respective voltage sources 73 and 74 to generate the potential difference between the developing roller 31 and the squeeze roller 34. Further, depending on the change in detection result by the current detecting sensor 75, the toner concentration of the liquid developer on the surface of the developing roller 31 is adjusted by the film forming electrode 33. For this reason, even when the developing roller 31 is changed by use of the image forming apparatus 1 for the long period, detection accuracy is not remarkably lowered compared with the case where the surface of the developing roller 31 is detected, so that the toner concentration can be always measured with high accuracy while reflecting a successive change. By this, the toner concentration of the liquid developer carried on the developing roller 31 can be detected with high accuracy over the long period.

Further, according to the image forming apparatus 1 of this embodiment, the film forming electrode 33 is applied as the toner concentration adjusting means, so that the toner concentration of the liquid developer can be adjusted on an upstream side of the squeeze roller 34. For this reason, feed-back control can be carried out so as to adjust the concentration on the upstream side of the squeeze roller 34 by calculating the resistance value Rd of the liquid developer with use of the squeeze roller 34, so that high-accuracy concentration adjustment can be realized.

Further, according to the image forming apparatus 1 of this embodiment, as the electroconductive member for energizing the developing roller 31, the squeeze roller 34 is applied. The squeeze roller 34 is positioned on a most upstream side after the liquid developer is formed in the film on the developing roller 31 and is not influenced by the image formed on the developing roller 31, and is made of metal for which there is no need to consider a shearing voltage when the squeeze roller 34 is regarded as the electrode, and therefore, the toner concentration of the liquid developer can be detected with high accuracy over the long period.

Second Embodiment

Figure 9:
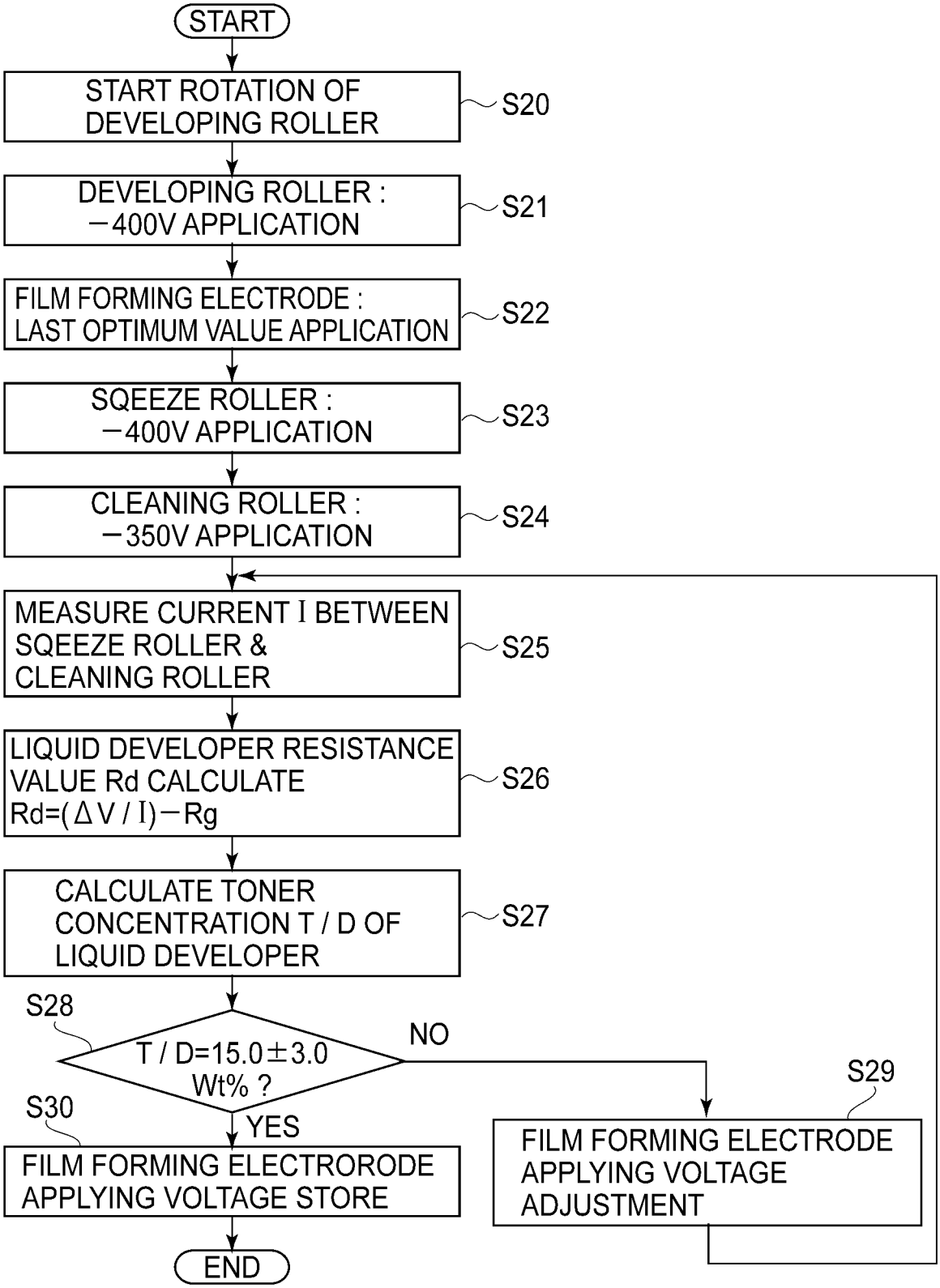
FIG. 9 is a flowchart showing a process procedure of a second mode in an image forming apparatus according to a Second Embodiment.

Next, the Second Embodiment of the present invention will be specifically described while making reference to FIG. 9. In this embodiment, a constitution is different from a constitution of the First Embodiment in which the squeeze roller 34 is applied, in that the cleaning roller 35 is applied as the electroconductive member. With this, the constitution of this embodiment is different from the constitution of the First Embodiment in that the cleaning roller voltage source 78 is applied as the voltage applying means and that the current detecting sensor 79 is applied as the current detecting means. That is, in this embodiment, control is carried out by calculating the toner concentration of the liquid developer carried on the developing roller 31 through calculation of the current when a certain voltage is applied to between the developing roller 31 and the cleaning roller 35. However, other constitutions are similar to those of the First Embodiment, so that the same symbols are used and detailed description will be omitted.

Also in this embodiment, for calculation of the toner concentration of the liquid developer on the developing roller 31, acquisition of the resistance value Rg of the surface layer 31*b* of the developing roller 31 is a necessary condition. Therefore, in this embodiment, the first mode is executed similarly as in the First Embodiment, so that the resistance value Rg of the surface layer 31*b* of the developing roller 31 is measured in advance. That is, also in this embodiment, the resistance value Rg of the surface layer 31*b* of the developing roller 31 is acquired by executing the first mode at the time of main switch actuation of the image forming apparatus 1 every morning. The resistance value Re of the carrier liquid and the coefficient α are known. Further, in this embodiment, a principal of detection of the toner concentration in the liquid developer carried on the developing roller 31 is similar to that in the second mode of the First Embodiment except that the cleaning roller 35 is used in place of the squeeze roller 34.

Next, a process procedure of the second mode in which the toner concentration of the liquid developer carried on the developing roller 31 is calculated from the resistance value Rg of the surface layer 31*b* of the developing roller 31 in this embodiment will be described along a flowchart shown in FIG. 9. Also here, description will be made inclusive of a process procedure in which after execution of the second mode, the toner concentration of the liquid developer carried on the developing roller 31 between the film forming electrode 33 and the developing roller 31 by feeding the calculated toner concentration back to a voltage to be applied to the film forming electrode 33. Incidentally, in this process procedure, a portion similar to that in the process procedure (see FIG. 8) of the First Embodiment will be omitted from detailed description.

Incidentally, in this embodiment, the toner concentration of the liquid developer sent toward the nip between the developing roller 31 and the cleaning roller 35 after image formation changes depending on an amount of the toner consumed for image formation between the developing roller 31 and the photosensitive drum 20. For this reason, in this embodiment, also the second mode is not carried out simultaneously with the image formation, but is carried out by providing an exclusive mode of about 30 s during a rest of the image formation.

After the start of the second mode, the controller 70 causes the developing roller 31 to start rotation (step S20). In this embodiment, the peripheral speed of the developing roller 31 is 785 mm/s. At this time, the cleaning roller 35 is contacted to the developing roller 31 through the liquid developer and rotates at the same speed as the developing roller 31. Subsequently, the controller 70 causes the voltage source to apply a voltage of −400 V to the developing roller 31 (step S21). The controller 70 causes the voltage source to apply a voltage last optimized to the film forming electrode 33 (step S22). At this time, a part of the negatively chargeable toner dispersed in the liquid developer is attracted toward the developing roller 31 side by the potential difference between the developing roller 31 and the film forming electrode 33.

In this state, the controller 70 causes the voltage source to apply a voltage of −400 V to the squeeze roller 34 (step S23). Between the developing roller 31 and the squeeze roller 34, the same potential is formed, and therefore the toner concentration of the liquid developer passing through between both the rollers 31 and 34 does not change before and after the nip 31*n*. Further, the controller 70 causes the voltage source to apply a voltage of −350 V to the cleaning roller 35 (step S24). At this time, the developing roller 31 has a potential difference of −50 V relative to the cleaning roller 35, and the controller 70 causes the current detecting sensor 75 to measure the current I flowing from the cleaning roller 35 toward the developing roller 31 by the current detecting sensor 79 (step S25). At this time, the liquid developer between both the rollers 31 and 35 and the surface layer 31*b* of the developing roller 31 act as resistors (respective electric resistances are Rd and Rg).

The acquired current I between the cleaning roller 35 and the developing roller 31 is sent as digital information to the CPU 71 through the A/D converter 80. The CPU 71 makes reference to the resistance value Rg stored in the memory 72 in the first mode, and calculates the resistance value Rd of the liquid developer carried on the developing roller 31 between both the rollers 31 and 35 by using the symbolic formula 3 (step S26). Then, the controller 70 calculates the toner concentration of the liquid developer through the symbolic formula 4 by using the calculated resistance value Vd of the liquid developer, the known resistance value Rc of the carrier liquid and the coefficient a (step 27).

Also in this embodiment, a target range of T/D of the liquid developer on the developing roller 31 is 15.0±3.0 wt. %. Therefore, the controller 70 discriminates whether or not T/D of the liquid developer actually carried on the developing roller 31 falls within the target range (step S28). In the case where the controller 70 discriminated that T/D of the liquid developer carried on the developing roller 31 does not fall within the target range, the controller 70 adjusts T/D of the liquid developer on the developing roller 31 by optimizing the voltage to be applied to the film forming electrode 33 (step S29). The controller 70 causes the current detecting sensor 75 to measure the current I flowing from the developing roller 31 toward the cleaning roller 35, again after adjusting the voltage to be applied to the film forming electrode 33 (step S25). On the other hand, in the case where the controller 70 discriminated that T/D of the liquid developer carried on the developing roller 31 falls within the target range, the controller 70 causes the memory 91 to store the voltage to be applied to the film forming electrode 22 without changing the voltage to be applied to the film forming electrode 33 (step S30), and ends the process of the second mode.

As described above, according to the image forming apparatus 1 of this embodiment, the controller 70 causes the respective voltage sources 73 and 74 to generate the potential difference between the developing roller 31 and the cleaning roller 35. Further, depending on the change in detection result by the current detecting sensor 75, the toner concentration of the liquid developer on the surface of the developing roller 31 is adjusted by the film forming electrode 33. For this reason, even when the developing roller 31 is changed by use of the image forming apparatus 1 for the long period, detection accuracy is not remarkably lowered compared with the case where the surface of the developing roller 31 is detected, so that the toner concentration can be always measured with high accuracy while reflecting a successive change. By this, the toner concentration of the liquid developer carried on the developing roller 31 can be detected with high accuracy over the long period.

In the image forming apparatus 1 of the above-described Second Embodiment, the case where the cleaning roller 35 is applied as the electroconductive member was described, but the present invention is not limited thereto. That is, in the Second Embodiment, there is a need to carry out the mode in a rest state of the image formation. For that reason, the mode is not carried out alone but is used in combination with the First Embodiment, and is used in an assisting manner, so that the toner concentration of the liquid developer carried on the developing roller 31 can be more finely controlled. In this case, a plurality of electroconductive members are provided, and the electroconductive members are the squeeze roller 34 and the cleaning roller 35.

Further, in the image forming apparatuses 1 of the First and Second Embodiments, as the electroconductive member at least one of the squeeze roller 34 and the cleaning roller 35 is applied, but the present invention is not limited thereto. As the electroconductive member, other than these, other members adjacent to the developing roller 31 may also be utilized as electrodes, and for example, the film forming electrode 33 and the photosensitive drum 20 may also be applied.

Further, in the First and Second Embodiments, the case where the film forming electrode 33 is applied as the toner concentration adjusting means was described, but is not limited thereto. For example, toner concentration adjustment or the like, such as the developer mixer 39, of the liquid developer in the developing liquid tank 32 in supply control of the liquid developer can be applied.

Embodiment 1

Figure 10:
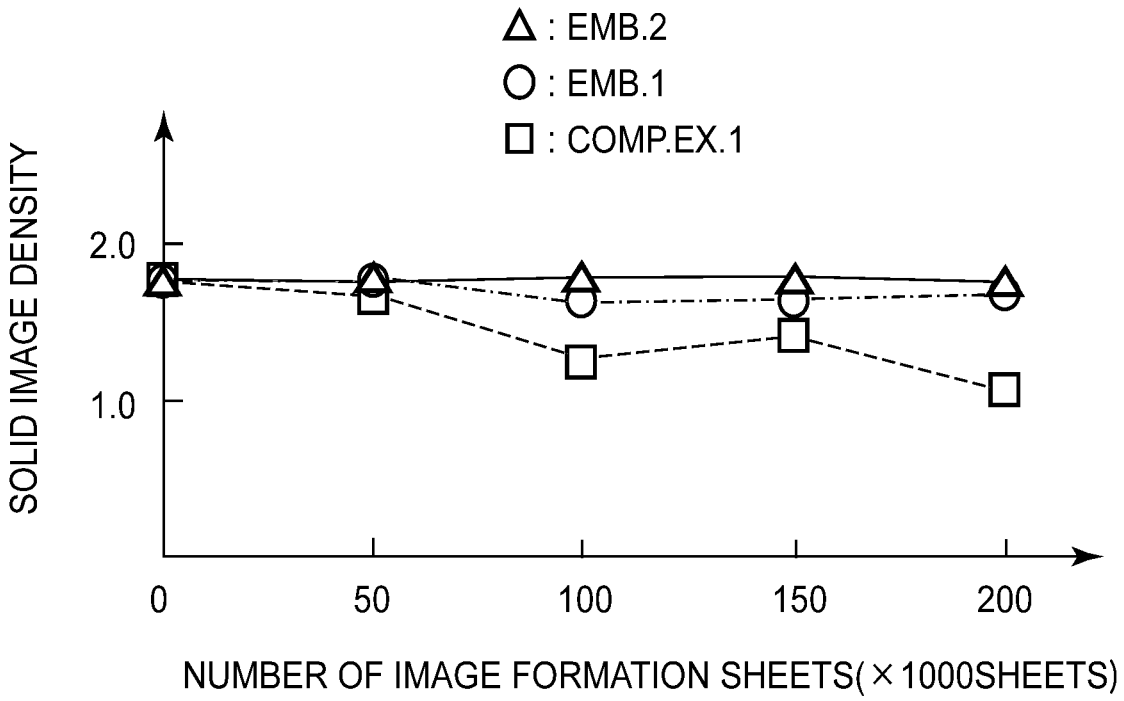
FIG. 10 is a graph showing a relationship between a number of image formation sheets and an image density in image forming apparatuses according to respective Embodiments and a comparison example.

By utilizing the image forming apparatus 1 of the above-described First Embodiment, solid images of 10%, in image ratio were printed for durability, so that a relationship between a number of image formation sheets and an image concentration was acquired. Here, image formation was carried out in a condition in which surface potentials of image portion/non-image portion on the photosensitive drum 20 were −200 V/−600 V, respectively, and in which applied voltages to developing roller 31/squeeze roller 34/cleaning roller 35 were −400/−450/−350 V, respectively. Further, in image evaluation, a solid portion density was measured every 50,000 sheets by a reflection densitometer (manufactured by X-Rite Inc.) A result thereof is shown in FIG. 10. As shown in FIG. 10, according to the image forming apparatus 1 of Embodiment 1, it was confirmed that the toner concentration of the liquid developer formed in the film on the developing roller 31 can be controlled to a desired value with accuracy and that the image density can be properly maintained over a long term.

Embodiment 2

By utilizing the image forming apparatus 1 of the above-described First and Second Embodiments, similarly as in Embodiment 1, solid images of 10%, in image ratio were printed for durability, so that a relationship between a number of image formation sheets and an image concentration was acquired. Incidentally, an image forming condition and a measuring means of the image density were similar to those in Embodiment 1. A result thereof is shown in FIG. 10. As shown in FIG. 10, according to the image forming apparatus 1 of Embodiment 2, it was confirmed that the toner concentration of the liquid developer formed in the film on the developing roller 31 can be more accurately controlled to a desired value by using the First and Second Embodiments in combination. Further, according to the image forming apparatus 1 of Embodiment 2, by using the First and Second Embodiment in combination, the image density can be properly maintained over a long term.

Comparison Example

By using an optical sensor provided opposed to the surface of the developing roller 31, an image forming apparatus for detecting the toner concentration of the liquid developer formed in the film on the developing roller 31 was used. By utilizing this image forming apparatus 1, similarly as in Embodiment 1, solid images of 10%, in image ratio were printed for durability, so that a relationship between a number of image formation sheets and an image concentration was acquired. A result thereof is shown in FIG. 10. As shown in FIG. 10, in the image forming apparatus 1 of the comparison example, the image density was lowered with an increase in number of image formation sheets. For this reason, different from Embodiments 1 and 2, it was confirmed that the toner concentration of the liquid developer formed in the film on the developing roller 31 cannot be controlled to a desired value with accuracy and that it is difficult to properly maintain the image density over a long term.

INDUSTRIAL APPLICABILITY

According to the present invention, there is provided an image forming apparatus in which the electrostatic latent image is developed by the wet developing type with use of the liquid developer in which the toner is dispersed in the medium liquid.

EXPLANATION OF SYMBOLS

1 . . . image forming apparatus, 31 . . . developing roller, 33 . . . film forming electrode (toner concentration adjusting means), 34 . . . squeeze roller (electroconductive member), 35 . . . cleaning roller (electroconductive member), 39*a* . . . developer concentration sensor (toner concentration detecting means), 70 . . . controller, 73 . . . developing roller voltage source (voltage applying means), 74 . . . squeeze roller voltage source (voltage applying means), 75 . . . current detecting sensor (current detecting means), 78 . . . cleaning roller voltage source (voltage applying means), 79 . . . current detecting sensor (current detecting means), C carrier liquid, D . . . liquid developer, T . . . toner.

The invention claimed is:

1. An image forming apparatus comprising:

an image bearing member;

a rotatable developing roller which includes an electroconductive layer and which carries a liquid developer containing toner and a carrier liquid, said developing roller carrying and feeding the liquid developer toward a developing position where an electrostatic latent image formed on said image bearing member is developed;

an electrode portion, provided with a predetermined interval from said developing roller upstream of the developing position with respect to a rotational direction of said developing roller and downstream of a starting position where the liquid developer is supplied to said developing roller, for forming a potential difference between itself and said developing roller;

an electroconductive roller, provided upstream of said developing position and downstream of said electrode portion with respect to the rotational direction of said developing roller, for urging said developing roller;

a first voltage generator generating a potential difference between said developing roller and said electrode portion;

a second voltage generator generating a potential difference between said developing roller and said electroconductive roller;

a current detector detecting a current flowing between said developing roller and said electroconductive roller; and a controller capable of controlling said first voltage generator, wherein said controller is capable of executing a first obtain mode in which said controller obtains a resistance value of said developing roller based on a detection result by said current detector when a potential difference between said developing roller and said electroconductive roller is generated by said second voltage generator in a state that said developing roller carries a reference liquid developer having a known toner concentration, wherein said controller is capable of executing a second obtain mode in which said controller obtains a toner concentration of the liquid developer on a surface of said developing roller based on the resistance value of said developing roller obtained by said first obtain mode and a detection result by said current detector when a potential difference between said developing roller and said electroconductive roller is generated by said second voltage generator in a state that the liquid developer is applied to said developing roller, and wherein during image formation, said controller controls said first voltage generator based on the toner concentration of the liquid developer on the surface of said developing roller obtained by said second obtain mode so that a toner concentration of the liquid developer on the surface of said developing roller is a target value.

2. An image forming apparatus according to claim 1, further comprising a toner concentration detector detecting the toner concentration of the liquid developer before the liquid developer is supplied to said developing roller, wherein said controller obtains the known toner concentration of the reference liquid developer by causing said toner concentration detector to detect the toner concentration of the reference liquid developer.

3. An image forming apparatus according to claim 1, wherein said electroconductive roller is a metal roller.

4. An image forming apparatus according to claim 1, wherein said developing roller includes the electroconductive layer on a metal roller.

* * * * *